United States Patent [19]

Furrer et al.

[11] Patent Number: 4,483,719

[45] Date of Patent: Nov. 20, 1984

[54] PROCESS FOR PREPARING FINE-GRAINED ROLLED ALUMINUM PRODUCTS

[75] Inventors: Peter Furrer, Pfungen; Jürgen Timm, Steisslingen, both of Switzerland; Frank Wehner, Singen, Fed. Rep. of Germany

[73] Assignee: Swiss Aluminium Ltd., Chippis, Switzerland

[21] Appl. No.: 537,942

[22] Filed: Sep. 30, 1983

[30] Foreign Application Priority Data

Aug. 23, 1983 [CH] Switzerland ..... 4584/83

[51] Int. Cl.[3] ..... C22F 1/04

[52] U.S. Cl. ..... 148/2; 148/11.5 A; 148/437; 420/550

[58] Field of Search ..... 148/2, 11.5 A, 437; 420/550

[56] References Cited

U.S. PATENT DOCUMENTS

| | | | |
|---|---|---|---|
| 3,266,945 | 8/1966 | Helling et al. | 148/11.5 A |
| 3,304,208 | 2/1967 | Jager | 148/11.5 A |
| 3,397,044 | 8/1968 | Bylund | 420/550 |
| 3,938,991 | 2/1976 | Sperry et al. | 148/11.5 A |
| 3,989,548 | 11/1976 | Morris | 148/2 |
| 4,028,141 | 6/1977 | Chia et al. | 148/11.5 A |
| 4,126,487 | 11/1978 | Morris et al. | 148/2 |
| 4,138,275 | 2/1979 | Yokota et al. | 148/11.5 A |

FOREIGN PATENT DOCUMENTS

| | | | |
|---|---|---|---|
| 0144813 | 12/1978 | Japan | 148/437 |

*Primary Examiner*—L. Dewayne Rutledge
*Assistant Examiner*—Robert L. McDowell
*Attorney, Agent, or Firm*—Bachman and LaPointe

[57] ABSTRACT

A process for the preparation of a rolled aluminum product, containing iron as the predominant alloy element, which has a grain size of less than 10 μm after annealing to at least 250° C., in which an alloy consisting of 0.8 to 1.5% iron, up to 0.5% by weight of each of Si and Mn, the sum of Si and Mn being between 0.2 and 0.8%, up to 0.3% by weight of any other component, the total of other components being no more than 0.8% by weight, and the remainder being aluminum, is casted at a solidification rate of 2.5 to 25 cm/min, the hot plate is cooled to less than 120° C. at a rate of less than 0.5 K/sec and is then cold rolled with a thickness decrease of at least 75% without intermediate annealing, and the final annealing temperature does not exceed 380° C.

3 Claims, No Drawings

PROCESS FOR PREPARING FINE-GRAINED ROLLED ALUMINUM PRODUCTS

BACKGROUND OF THE INVENTION

Rolled aluminum products prepared from hitherto known alloys, prepared by the use of conventional procedures, after annealing at over 250° C., have grains in the size range of 15 to 50 μm. However, a process is known, according to which aluminum-iron alloys are worked up into sheet products which, after final annealing in the range between 250 to 400° C., have a grain size below 3 μm. However, this process requires the introduction of special casting apparatus which allows solidification rates of more than 25 cm/min. In conventional DC-casting methods, the solidification rate is between 5 and 12 cm/min.

It is the principal object of the present invention to provide a process for the preparation of rolled products, made of aluminum-iron alloys which, at final gauge, after annealing at more than 250° C., have a grain size below 10 μm, by a process using conventional semi-continuous ingot DC-casting apparatus.

SUMMARY OF THE INVENTION

The invention relates to a process for the preparation of rolled aluminum containing iron as the primary alloy element which, after annealing to at least 250° C., have a grain size of less than 10 μm. By "grain size" is meant the average diameter of all the grains present. The presence of such small grains in the annealed state is desirable for high strength or yield point with simultaneously good formability; this applies for all ranges of thickness, from mm sheets to foils of a few μm.

DETAILED DESCRIPTION

According to the present invention, an aluminum alloy consisting of from 0.8 to 1.5 percent by weight iron, up to 0.5 percent by weight of each of Si and Mn, the sum of Si and Mn being between 0.2 and 0.8 percent by weight, and no more than 0.3 percent by weight of any other component, the total of such other components being no more than 0.8 percent by weight, is casted at a solidification rate of 2.5 to 25 cm/min., the hot plate is cooled to less than 120° C. at a rate of at least 0.5 K/sec. and is then cold rooled with a thickness decrease of at least 75% without intermediate annealing, and the final annealing temperature does not exceed 380° C.

By choosing the alloy composition and the three thermo-mechanical process criteria (which are easy to control), for all casting methods with a solidification rate between 2.5 and 25 cm/min., a process is defined which allows the production of annealed sheets, strips or foils which have a grain size of preferably between 1 and 5 μm, and in any case less than 10 μm. The process of the invention is less suitable for solidification rates outside the given range.

The ratio of formability to strength can be increased by the use of increased final annealing temperatures. However, in using the alloy specified in the invention, the annealing temperature should not exceed 380° C., in order to ensure that grains more than 10 μm in size are avoided.

It is also critical, in order to obtain fine grains, to control the process steps subsequent to hot working. Experiments show that, between the final hot working temperature and about 120° C., the cooling rate should not exceed 0.5 K/sec.; cooling below 120° C. is not significant. Such cooling rates can be achieved by passing the plate through a water tank or by cooling using a strong air stream.

After hot rolling, there should be no annealing, before the cold rolled strip reached one-quarter or less than of the hot rolling gauge.

The proportion of iron must be greater than 0.8% by weight; otherwise, grains may be generated, after annealing, which are more than 10 μm in size. If the iron content is more than 1.5% by weight, the composition is in the region of eutectic; this involves the danger of the formation of coarse precipitations, which would adversely affect the formability.

If the Si or Mn content exceeds 0.5% by weight, or their sum is more than 0.8% by weight, there is the same danger of precipitation of coarse particles. It is difficult to avoid the formation of grains more than 10 μm in size if the sum of the two components is less than 0.2% by weight.

It is advantageous if the lower limit for the iron content is 1.1% by weight and that for Mn 0.25% by weight. Lower contents can cause the formation of a grain size, which is not substantially lower than 10 μm. In addition, the possibility of corrosion is increased when the Mn content is less than 0.25% by weight.

Experiment has shown that limitation of the Fe/Mn weight ration between 2.5:1 and 4.5:1 is particularly advantageous with respect to the object of obtaining fine grains.

Further advantages, characteristics and details of the invention will be apparent from the following description of preferred examples. The abbreviation "I" indicates that the experimental procedure is in accordance with the invention, while "C" indicates a comparative test. "Rm" stands for the ultimate tensile strength, "Rpo.2" for the yield strength (after 0.2% remaining elongation) and "A 100" for the elongation, relative to a test length of 100 mm.

EXAMPLE 1

Influence of the alloy in producing thin strips:

| Alloy | Fe | Si | Mn | Others, Each |
|---|---|---|---|---|
| I 1 | 1.3 | 0.1 | 0.4 | ≦0.01 |
| C 1 | 0.8 | 0.7 | 0.01 | ≦0.01 |

C1 is a conventional alloy for thin strip.

Ingots (412×1000 mm in cross section) were prepared from both alloys by the DC-casting process, using a casting rate of 10 cm/min.; the solidification rate was 7 cm/min. The ingots were scalped, preheated to 540° C. and hot rolled to 8 mm. The hot rolled strip was passed through a water tank and cold rolled to 0.7 mm. The product was annealed at 350° C. for 3 hours and then cold rolled to 0.1 mm. After final annealing at 320° C. for 20 hours, the following values were obtained (the mechanical values are measured in the roll direction):

| | Rm (MPa) | Rpo. 2 (MPa) | A 100 (%) | Grain Size (μm) |
|---|---|---|---|---|
| I 1 | 125 | 75 | 29 | 4 |
| C 1 | 95 | 35 | 27 | 25 |

EXAMPLE 2

Influence of the alloy in producing foils:

| Alloy | Fe | Si | Mn | Others, Each |
|---|---|---|---|---|
| I 2 | 1.25 | 0.15 | 0.35 | ≦0.01 |
| I 2' | 1.5 | 0.25 | 0.01 | ≦0.01 |
| C 2 | 0.55 | 0.15 | 0.01 | ≦0.01 |

C2 is a conventional alloy for foils.

The alloys were processed, as in Example 1, to a thickness of 0.1 mm. They were then cold rolled to 13 μm and, finally, annealed at 280° C.

| | Rm (MPa) | Rpo. 2 (MPa) | A 100 (%) | Grain Size (μm) |
|---|---|---|---|---|
| I 2 | 115 | 90 | 6 | 7 |
| I 2' | 105 | 70 | 6 | 9 |
| C 2 | 70 | 35 | 4 | 25 |

EXAMPLE 3

Influence of the cooling rate after hot rolling:

| Alloy | Fe | Si | Mn | Others, Each |
|---|---|---|---|---|
| 3 | 1.1 | 0.15 | 0.3 | ≦0.01 |

The procedure of Example 1 was followed in one experiment (I 3). In a comparative experiment (C 3), it was altered in that the hot rolled plate was not passed through a water tank, but was immediately coiled.

| | Rm (MPa) | Rpo. 2 (MPa) | A 100 (%) | Grain Size (μm) |
|---|---|---|---|---|
| I 3 | 115 | 70 | 25 | 9 |
| C 3 | 100 | 45 | 16 | 40 |

EXAMPLE 4

Influence of the final annealing temperature:

| Alloy | Fe | Si | Mn | Others, Each |
|---|---|---|---|---|
| 4 | 1.3 | 0.2 | 0.4 | ≦0.01 |

The procedure of Example 1 was followed to 0.1 mm. In a comparative experiment (C 4), the 20 hour annealing was conducted at 400° C. rather than 320° C.

| | Rm (MPa) | Rpo. 2 (MPa) | A 100 (%) | Grain Size (μm) |
|---|---|---|---|---|
| I 4 | 125 | 80 | 28 | 5 |
| C 4 | 115 | 50 | 25 | 15 |

EXAMPLE 5

Influence of the cold rolling degree between the hot rolling exit gauge and the thickness at the first annealing stage:

The alloy used in Example 1 was processed down to water-cooling of the hot rolled plate as in Example 1. Subsequently, it was cold rolled to 2.8 mm, annealed at 360° C. for three hours, further rolled to 0.8 mm, annealed at 350° C. for three hours, rolled to 0.1 mm and finally, as in Example 1, annealed at 320° C. for twenty hours (C 5).

| | Rm (MPa) | Rpo. 2 (MPa) | A 100 (%) | Grain Size (μm) |
|---|---|---|---|---|
| I 1 | 125 | 75 | 29 | 4 |
| C 5 | 115 | 55 | 28 | 30 |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the preparation of a rolled aluminum sheet characterized by a grain size of less than 10 μm when annealed to a temperature of at least 250° C., high strength and good formability comprising:

providing an aluminum base alloy consisting essentially of 0.8 to 1.5 wt.% iron, up to 0.5 wt.% silicon and manganese wherein the total silicon and manganese content is between 0.2 to 0.8 wt.% and up to 0.3 wt.% of any one impurity not to exceed a total of 0.8 wt.% impurities, balance essentially aluminum;

casting said alloy at a solidification rate of 2.5 to 25 cm/min.;

rolling the cast ingot to form a hot rolled plate;

cooling said hot rolled plate to less than 120° C. at a cooling rate of less than 0.5 K/sec.;

cold rolling said cooled hot rolled plate without prior annealing to a thickness reduction of at least 75%; and annealing said cold rolled sheet at a temperature of from 250°-380° C.

2. A process according to claim 1 wherein said alloy comprises greater than 1.1 wt.% iron and greater than 0.25 wt.% manganese.

3. A process according to claim 1 wherein said alloy has a ratio of iron to manganese of between 2.5:1 to 4.5:1.

* * * * *